US005156890A

United States Patent [19]

Rock

[11] Patent Number: 5,156,890

[45] Date of Patent: Oct. 20, 1992

[54] METHOD FOR FLAME RETARDING FABRICS

[76] Inventor: James E. Rock, 412 E. Lorengo Ave., Norfolk, Va. 23503

[21] Appl. No.: 653,030

[22] Filed: Feb. 8, 1991

[51] Int. Cl.[5] ..... B05D 3/12; B05D 3/00

[52] U.S. Cl. ..... 427/240; 427/242; 427/322; 427/323; 427/324; 427/394; 427/396

[58] Field of Search ..... 8/158; 68/18 F; 427/242, 439, 322–324, 396, 394, 240, 393.3

[56] References Cited

U.S. PATENT DOCUMENTS

| | | | |
|---|---|---|---|
| 54,382 | 5/1866 | McGill | 252/608 X |
| 72,830 | 12/1867 | Fell | 252/608 X |
| 1,720,926 | 7/1939 | Shiga | 252/608 |
| 2,668,784 | 2/1954 | Dills | 252/608 X |
| 3,687,720 | 8/1972 | Grunewalder | 252/608 X |

OTHER PUBLICATIONS

10 Kirk–Othmer Encyclopedia of Chemical Technology 420–44 (John Wiley & Sons, New York, 3d ed 1980).

Advances in Fire Retardants–Part I, vol. 2 Progress in Fire Retardancy Series 73–92 (V. Bhatnager, Ed., Technomic Publishing Co., Westport, Conn. 1972).

J. Reid et al., Making Household Fabrics Flame Resistant (Leaflet No. 454 U.S.D.A. 1967).

*Primary Examiner*—Evan Lawrence

*Attorney, Agent, or Firm*—Leydig, Voit & Mayer

[57] ABSTRACT

A method for imparting flame resistance to fabric articles comprising natural or regenerated fibers is provided for. The method comprises: applying a detergent solution to fabric articles; rinsing the detergent solution from the fabric articles; applying an aqueous solution of one or more water-soluble flame retardant compounds to the damp fabric articles; removing excess amounts of the aqueous flame retardant solution from the fabric articles; recycling the excess amount of the aqueous retardant solution for use in treating other fabric articles; filtering the recycled aqueous flame retardant solution; and drying the fabric articles.

6 Claims, 2 Drawing Sheets

METHOD FOR FLAME RETARDING FABRICS

TECHNICAL FIELD

This invention is related generally to methods and apparatus for imparting flame resistance to fabrics, and in particular, to methods and apparatus which utilize water soluble flame retardants and which impart flame resistance to fabrics comprising natural and regenerated fibers.

BACKGROUND OF THE INVENTION

A variety of articles are made from fabric comprising natural fibers, e.g., cotton, flax, silk, and wool, and regenerated fibers, e.g., rayon. Natural or regenerated fabrics, especially cotton, are widely used in clothing because they are lightweight and comfortable. They are combustible, however, and articles fabricated therefrom may be used under conditions which create a risk that they will catch fire. Accordingly, various efforts have been made to make natural and regenerated fabrics more flame resistant.

One of the earliest approaches involved the application of various water soluble compounds. For example, the use of ammonium sulfate and a mixture of ammonium sulfate and ammonium phosphate are disclosed in nineteenth century patents. U.S. Pat. No. 54,382 to J. McGill (1866); U.S. Pat. No. 72,830 to A. Fell (1867). Water soluble flame retardant compounds are relatively inexpensive and provide efficient flame resistance. They also can be easily applied by impregnating the fabric with a water soluble solution of the retardant, followed by drying.

A principal disadvantage of the water soluble flame retardants, however, is that they impart a nondurable finish to the fabric which is removed during laundering and must be renewed after each laundering. This has led to widespread disregard of water soluble retardants in fabric articles, such as clothing, which may be washed many times during the course of their useful life.

This lack of durability can be improved somewhat by precipitating inorganic oxides on the fabric, for example, hydrated tungsten trioxide and stannic acid. Such finishes are semidurable, i.e., they resist from about one to fifteen launderings, and are adequate for applications such as drapes, upholstery, and mattress ticking.

Because many fabric articles, such as clothing, are subjected to many launderings, however, the emphasis has been on developing so-called durable finishes. Durable finishes may be imparted, e.g., by insoluble inorganic salts or oxides, such as antimony oxide, with a chlorinated organic vehicle, such as chlorinated paraffin. While durable finishes are in general more expensive per application, they are believed to offer overall efficiency because a single application can impart a finish that will withstand fifty or more launderings.

For many articles, cost efficiency can be achieved if the useful life of the article is long enough. It has not been fully appreciated that, as a practical matter, many articles become unacceptably soiled or worn over a relatively short time period and, for such articles, the cost of a durable finish is unacceptably high.

Durable finishes present other types of problems as well. Conventional laundering processes typically leave clothing with a durable finish in a highly wrinkled state. Accordingly, it generally is necessary to apply heavy starching when ironing in order to impart a neat appearance to the clothing.

An object of the subject invention, therefore, is to provide methods and apparatus for easily and economically imparting flame resistance to fabrics comprising natural or regenerated fabrics.

Another object is to provide such methods and apparatus whereby the treated fabric article may be more easily and economically ironed into a neat appearance.

A further object of the subject invention is to provide methods and apparatus wherein all of the above mentioned advantages are realized.

These and other objects and advantages of the invention will be apparent to those skilled in the art upon reading the following description and upon reference to the drawings.

SUMMARY OF THE INVENTION

The invention provides for a method for imparting flame resistance to fabric articles comprising natural or regenerated fibers, which method comprises: applying a detergent solution to fabric articles; rinsing the detergent solution from the fabric articles; applying an aqueous solution of one or more water-soluble flame retardant compounds to the damp fabric articles; removing excess amounts of the aqueous flame retardant solution from the fabric articles; recycling the excess amount of the aqueous retardant solution for use in treating other fabric articles; filtering the recycled aqueous flame retardant solution; and drying the fabric articles.

The subject invention also provides for an improved laundering apparatus of the type wherein there is a laundering tank, a rotatable basket disposed within the laundering tank for receiving clothes to be laundered, means for introducing aqueous detergent or rinse solutions into the laundering tank, and means for evacuating the aqueous solutions from the laundering tank, wherein the improvement comprises a tank for storing an aqueous solution of one or more water-soluble flame retardant compounds; flow means for introducing a predetermined amount of said aqueous flame retardant solution from the storage tank into the laundering tank; flow means for returning the aqueous flame retardant solution from the laundering tank to the storage tank; and filtration means for filtering the aqueous flame retardant solution.

Further, the subject invention provides for an accessory kit whereby conventional laundering equipment may be modified such that it is capable of treating fabric articles with an aqueous flame retardant solution, which accessory kit comprises a tank for storing aqueous flame retardant solutions; flow means for introducing a predetermined amount of aqueous flame retardant solution from the storage tank into the laundering tank; flow means for returning aqueous flame retardant solution from the laundering tank to the storage tank; and filtration means for filtering aqueous flame retardant solution.

As will become apparent from the description which follows, the methods and apparatus of the subject invention allow for the use of nondurable water-soluble flame retardants in fabric articles, such as clothing which are expected to be laundered many times during their useful life. Because the aqueous solution of water-soluble flame retardants is recycled, the novel methods and apparatus provide an economical alternative to the use of durable flame-retardant finishes. Finally, it has been observed that clothes treated by the method and apparatus of the subject invention may be provided with a neat appearance by ironing with little or no added starch.

DETAILED DESCRIPTION OF THE INVENTION

Figure 1:
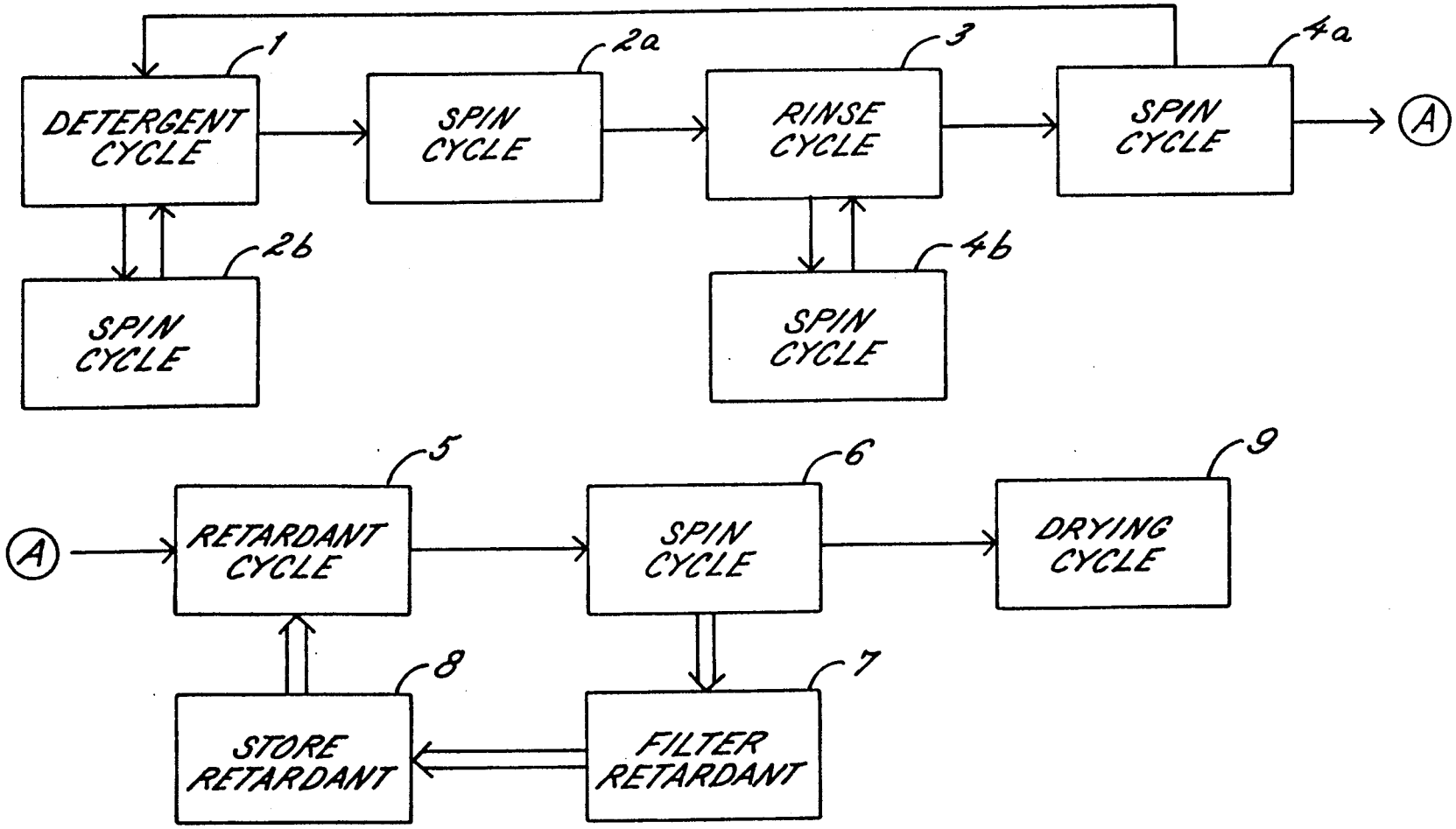
FIG. 1 is a flow diagram of a preferred embodiment of the flame-retardant application method of the subject invention.

As best shown in FIG. 1, the method of the subject invention comprises one or more detergent cycles 1 and one or more rinse cycles 3. These detergent and rinse cycles, preferably with agitation and intermediate spin cycles 2*a*, 2*b*, 4*a*, 4*b*, may be practiced in the same manner as is practiced in conventional laundering methods for fabric articles made from natural and regenerated fibers.

After the fabric articles have been washed and the detergent rinsed therefrom, an aqueous solution of one or more water-soluble flame retardant compounds is applied to the damp fabrics 5. Preferably, this is accomplished by immersing the fabric article in the aqueous solution and agitating the articles because thereby the flame retardant solution may be more quickly and uniformly dispersed therein. Thereafter, the excess flame retardant solution is removed from the fabric articles 6. Preferably, this is done by draining the flame retardant solution and spinning the fabric articles as is done following conventional rinsing.

It will be appreciated that amounts considerably in excess of that needed to saturate the fabric articles with flame retardant solution preferably are used. In accordance with a principal object of the invention, this excess flame retardant solution is recycled and stored 8 for use in treating additional articles. Thereby significant cost savings are achieved and the amount of effluent from the treatment process is reduced. Prior to its further use, however, the aqueous solution 7 is filtered to remove lint and other particulate matter which may have been introduced therein during the course of its application to the fabric articles. Thereafter, the fabric articles are dried 9 by conventional means.

Preferably, the methods of the subject invention are practiced by using the novel laundering apparatus. Preferred embodiments of the novel apparatus, generally speaking, may be fabricated conveniently and economically by modifying or incorporating certain features of conventional laundering equipment.

The design of such conventional laundering equipment is well known. Typically, they comprises a laundering tank, and disposed within the laundering tank, a rotatable basket into which may be placed fabric articles to be laundered. Such apparatus further comprises various flow means for introducing, and subsequently evacuating detergent and rinse solutions into the laundering tank.

The flow means, as is well known, include appropriate tubing, valves, and, if necessary, pumps. The valves and pumps are controlled electronically according to predetermined and selectable cycles. Additionally, conventional laundering equipment usually is equipped with various means for agitating the fabric articles in the tank during the various detergent and rinse cycles.

Figure 2:
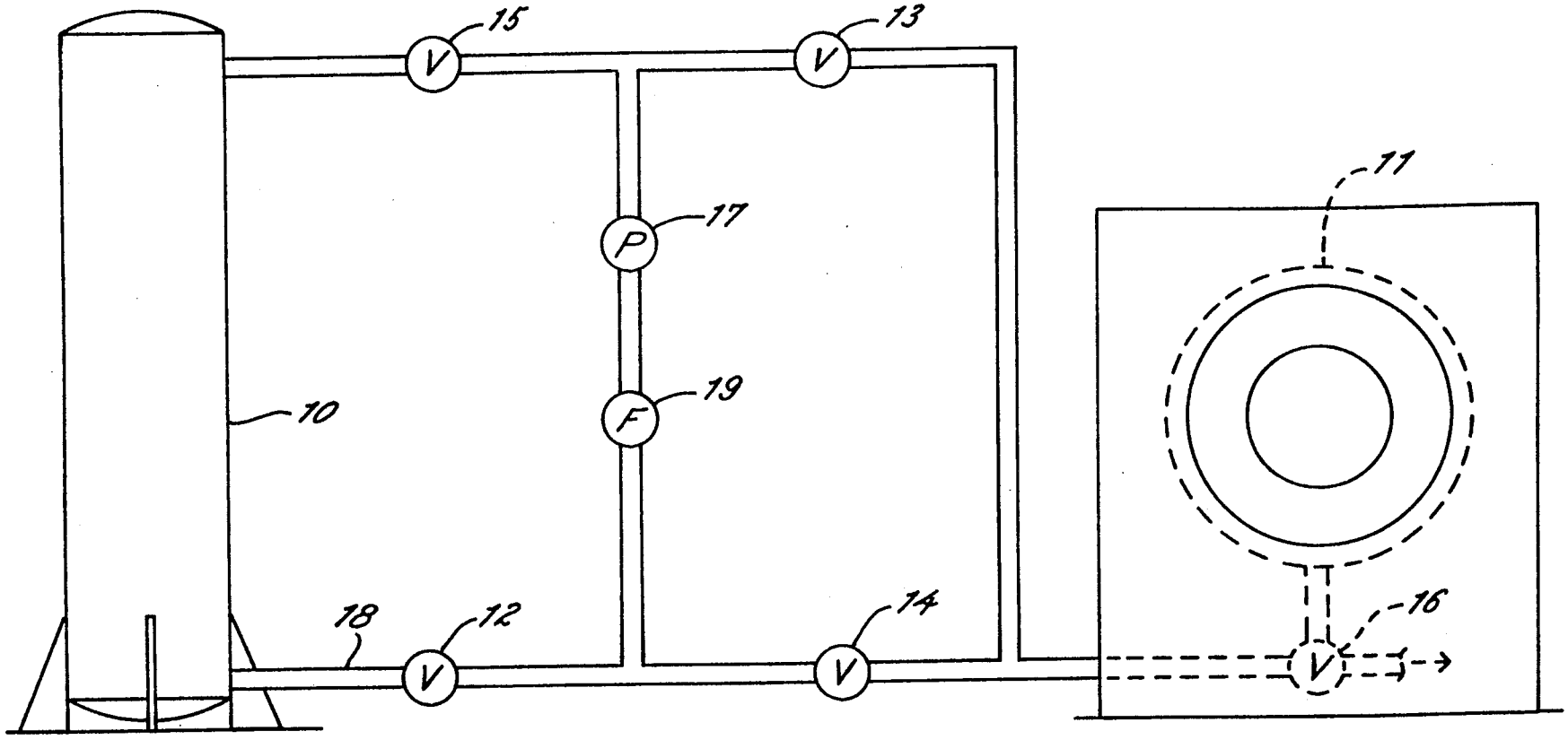
FIG. 2 is a schematic diagram of a preferred embodiment of the improved laundering apparatus of the subject invention.

The modifications by which conventional laundering equipment may be adapted in accordance with a preferred embodiment of the subject invention is best shown in FIG. 2. As shown therein, a storage tank 10 is provided for holding the aqueous flame retardant solution. In order to introduce flame retardant solution into the laundering tank 11 valves 12 and 13 are opened. Valves 14 and 15 are closed, and the drainage valve 16 of the laundering tank 11 is closed. Flame-retardant solution then may be transferred by a pump 17 through appropriate pipes 18 and a filter 19 into the laundering tank.

To drain the retardant solution, valves 12 and 13 are closed and valves 14 and 15 are opened. The flame retardant solution then is pumped back into the storage tank 10.

Preferably, the valves 12, 13, 14, 15, and 16 are solenoid valves or otherwise are electrically controlled via an appropriate control box (not shown) as are well known in the art. Likewise, a variety of conventional pumps may be used in the subject invention. It will be appreciated, however, that by situating the storage tank substantially above or below the laundering tank it will not be strictly necessary to pump aqueous flame retardant solution into or out of the laundry tank, respectively.

A filter 19 is provided to remove lint and other particulate matter from the aqueous flame retardant solutions. A variety of such filters are well known in the art and may be used. For example, commercially available basket-type filters have been found to provide satisfactory results. Preferably the filter is incorporated into the connecting plumbing such that the flame retardant solution passes therethrough during both its introduction into and evacuation from the laundering tank. A single pass through, however, would be expected to provide satisfactory results.

The flame retardants which may be used in general comprise any of the well known water soluble flame-retardant compounds and mixes thereof. In general, such retardants include various phosphorus, sulfur, bromine, or boran compounds. The watersoluble flame retardants most widely used for textiles include various mixtures of borax, boric acid, diammonium phosphate, sodium phosphate dodecahydrate, ammonium sulfamate, ammonium sulfate, ammonium bromide, sodium phosphate, and sodium tungstate dihydrate. In particular, mixtures of such compounds include borax and boric acid (70/30), borax, boric acid, and diammonium phosphate (47/20/33), sodium phosphate dodecahydrate and boric acid (50/50), boric acid and diammonium phosphate (50/50), borax, boric acid, and sodium phosphate dodecahydrate (50/35/15), ammonium sulfamate and diammonium phosphate (75/25), and borax, boric acid, sodium phosphate, and sodium tungstate dehydrate (15/47/18/20). Mixtures of such compounds also include borax, ammonium phosphate, and ammonium sulfate.

The flame retardant compounds should be added to the fabric article in quantities sufficient to impart the desired flame resistance. The precise amount will vary somewhat according to the effectiveness of the compound and the nature of the fabric. For example, if synthetic fibers are incorporated into the fabric, it generally will be necessary to add higher amounts of flame retardants.

In general, however, add-on weights of from about 12 to 15 wt % will provide satisfactory results for fabrics composed of natural or regenerated fibers. Lesser amounts will tend to decrease the flame resistance of the fabric article, and additional amounts tend to increase the stiffness.

The concentration of the aqueous solution that will provide the desired add-on weight will vary somewhat, primarily according to the amount of solution which will be evacuated from the treated fabric articles. That is, with little or no effective spinning, the treated fabric articles will retain a great deal of flame retardant solution. Under such conditions a more dilute solution, as low as about 8 wt %, may be used.

Generally, however, it is preferred that the clothes be spun until they are left only slightly damp. Using a more effective spin cycle, however, requires that higher flame retardant concentrations be used, up to about 30 wt %. With typical commercial laundry equipment, however, a concentration of from about 24 to about 27 wt % will provide satisfactory add-on weights.

The invention is further described by reference to the following example. It is not intended to limit the scope of the invention; rather, it is presented merely to facilitate the practice of the invention by those of ordinary skill in the art and to further disclose the inventor's best mode of doing so.

EXAMPLE 1

A Milnor 60-pound commercial machine with hydraulic balancing sold by Pellerin Milnor Corp., Kenner, La., was modified substantially as shown in FIG. 2. A vented 150 - gallon stainless steel tank was provided for storing the flame-retardant solution. Solanoid valves commercially available from Conbraco Industries Inc., Pageland, S.c., and a basket filter having a 1/16" plastic mesh and commercially available from American Products, Moorpark, Calif., were used. Flexible polyethylene tubing was used to connect the various components.

Lightweight cotton denim dungarees may be treated with a 24 wt % aqueous solution of a 30/50/20 mixture of borax, ammonium phosphate, and ammonium sulfate. In particular, they may be subjected, in succession, to a wash, spin, rinse, spin, flame-retardant rinse, and spin cycles. The flame retardant rinse cycle may be for 2–10 minutes, with agitation provided. The final spin cycle will leave the clothes slightly damp. Thereafter, the dungarees may be dried in conventional drying equipment.

It will be observed that the cotton dungarees are flexible and comfortable, and that they can be pressed neatly without any additional starch. Additionally, it will be observed that the cotton dungarees will pass standard vertical flammability tests, such as those described in Federal Test Method Standard 191-Method 5903.

While this invention has been disclosed and discussed primarily in terms of specific embodiments thereof, it is not intended to be limited thereto. Other modifications and embodiments will be apparent to the worker in the art.

I claim:

1. A method for imparting flame resistance to fabric articles comprising natural or regenerated fibers, which method comprises:

(a) applying a detergent solution to said fabric articles;

(b) rinsing said detergent solution from said fabric articles;

(c) applying an aqueous flame retardant solution comprising one or more water-soluble flame retardant compounds to said damp fabric articles;

(d) removing excess amounts of said aqueous flame retardant solution from said fabric articles;

(e) recycling said excess amounts of said aqueous flame retardant solution for use in treating other fabric articles;

(f) filtering said recycles aqueous flame retardant solution; and (g) drying said fabric articles.

2. The method of claim 1, wherein said one or more water-soluble flame retardant compounds are selected from the group consisting of borax, boric acid, diammonium phosphate, sodium phosphate dodecahydrate, ammonium sulfamate, ammonium sulfate, ammonium bromide, sodium phosphate, and sodium tungstate dihydrate.

3. The method of claim 1, wherein said one or more water-soluble flame retardant compounds are selected from the group consisting of mixtures of: borax and boric acid; borax, boric acid, and diammonium phosphate; sodium phosphate dodecahydrate and boric acid; boric acid and diammonium phosphate; borax, boric acid, and sodium phosphate dodecahydrate; ammonium sulfamate and diammonium phosphate; borax, boric acid, sodium phosphate, and sodium tungstate dihydrate; and borax, ammonium phosphate, and ammonium sulfate.

4. The method of claim 1, wherein said aqueous solution of one or more water-soluble flame retardant compounds comprises from about 8 to about 30 wt % of said flame retardant compounds.

5. The method of claim 2, wherein said aqueous solution of one or more water-soluble flame retardant compounds comprises from about 8 to about 30 wt % of said flame retardant compounds.

6. The method of claim 3, wherein said aqueous solution of one or more water-soluble flame retardant compounds comprises from about 8 to about 30 wt % of said flame retardant compounds.

* * * * *

UNITED STATES PATENT AND TRADEMARK OFFICE

CERTIFICATE OF CORRECTION

PATENT NO. : 5,156,890

DATED : October 20, 1992

INVENTOR(S) : JAMES E. ROCK

It is certified that error appears in the above-identified patent and that said Letters Patent is hereby corrected as shown below:

On the Title Page:

[56] References Cited

U.S. Patent Documents

Patent No. 1,720,926 to Shiga, delete "7/1939" and substitute therefor -- 7/1929 --.

Column 5, line 35, delete "S.c." and substitute therefor -- S.C. --; and

Column 6, line 22, delete "recycles" and substitute therefor -- recycled --.

Signed and Sealed this

Twelfth Day of October, 1993

*Attest:*

*Attesting Officer*

Bruce Lehman

BRUCE LEHMAN

*Commissioner of Patents and Trademarks*